United States Patent [19]

Nuber

[11] Patent Number: 4,943,217

[45] Date of Patent: Jul. 24, 1990

[54] DELIVERY VALVE OF A ROTARY PISTON COMPRESSOR

[75] Inventor: Roland Nuber, Lindau, Fed. Rep. of Germany

[73] Assignee: Wankel GmbH, Berlin, Fed. Rep. of Germany

[21] Appl. No.: 303,542

[22] Filed: Jan. 27, 1989

[51] Int. Cl.[5] ..... F04C 29/08

[52] U.S. Cl. ..... 418/270; 137/512.15

[58] Field of Search ..... 418/270, 15; 137/512.15, 852, 853, 855

[56] References Cited

U.S. PATENT DOCUMENTS 4,668,172 5/1987 Shibuya ..... 418/270
4,700,740 10/1987 Mitsumoto et al. ..... 137/512.15
4,764,099 8/1988 Nakajima ..... 418/270

FOREIGN PATENT DOCUMENTS 3307856 9/1984 Fed. Rep. of Germany .

*Primary Examiner*—John J. Vrablik
*Assistant Examiner*—David L. Cavanaugh
*Attorney, Agent, or Firm*—Robert W. Becker & Associates

[57] ABSTRACT

A delivery valve having a cylindrical sleeve in which are provided valve slots that extend in a circumferential direction and in front of which are disposed cylindrically bent valve reeds. The sleeve can be placed in axis-parallel bores in the housing of a rotary piston compressor for gaseous medium. Provided in the sleeve and in the walls of the housing bore are pockets to allow gaseous medium to flow about the valve reeds when they are in an opening position.

4 Claims, 1 Drawing Sheet

DELIVERY VALVE OF A ROTARY PISTON COMPRESSOR

BACKGROUND OF THE INVENTION

1. Field of the Invention

The present invention relates to a delivery valve that includes a housing in the form of a cylindrical sleeve having valve slots that extend in a circumferential direction and in front of which are disposed cylindrically bent valve tongues or reeds that, in an opening position, rest against travel-receivers in an elliptically bent configuration The sleeve is disposed in a wall portion of a rotary piston compressor for gaseous medium, the sleeve being disposed in the wall portion in a bore thereof that extends parallel to the shaft axis of the compressor. The bore communicates with a respective delivery chamber of the compressor via delivery ports in the compressor wall portion, and in a radial direction communicating on at least one side with a delivery line.

2. Description of the Prior Art

A delivery valve of this general type is disclosed in German Offenlegungsschrift No. 33 07 856 Eiermann dated Sept. 6, 1984, belonging to the assignee of the present invention and is described in principle in U.S. Pat. No. 4,149,834 Eiermann et al dated Apr. 17, 1979.

With the great length of the valve reeds of such an arrangement, and the freely pivotable ends thereof, the necessary bending stresses during opening of the valve are distributed over the entire length expansion of the valve reeds, and as a result of this low stress, a high operational reliability and a long service life are achieved.

However, in the construction disclosed in German Offenlegungsschrift No. 33 07 856 Eiermann, the gases that discharge radially when the valve is opened have a restricted path for passing from the valve slots in the axial direction on the one hand, and laterally about the valve reeds and the space between the individual travel-receivers to the lateral outlet or outlets of the valve. As a result, and due to the turbulence generated thereby, pressure increases and flow resistance results in the discharged gases.

It is therefore an object of the present invention to avoid these drawbacks by expanding the flow paths of the pressurized gases through the delivery valve with structurally easy to manufacture measures.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 1:
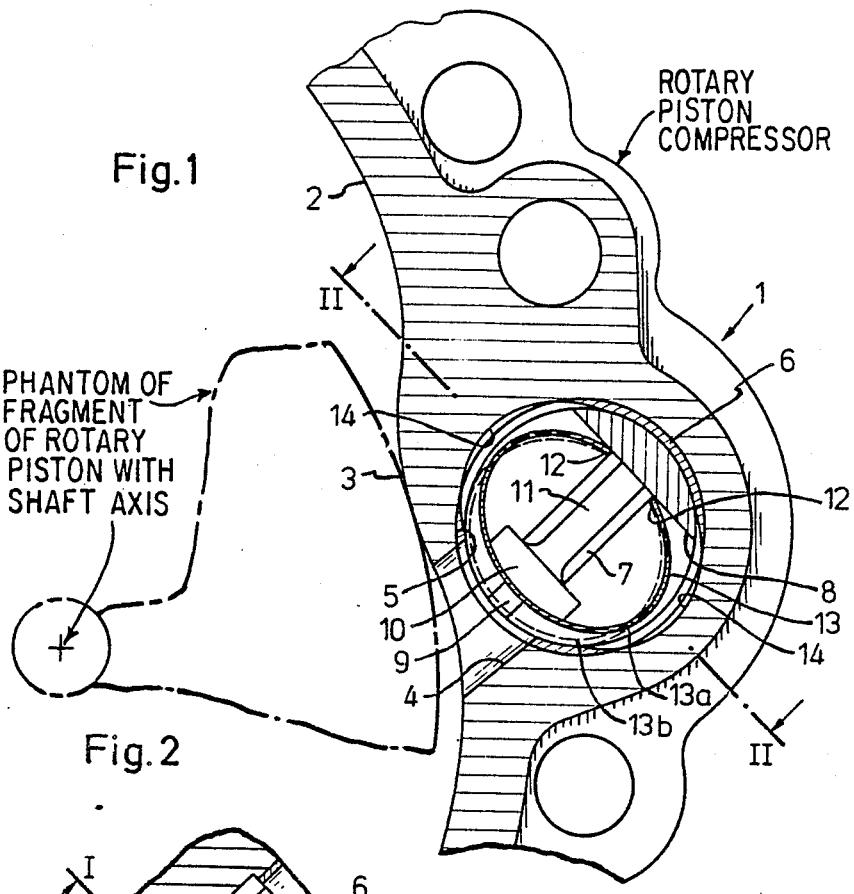
FIG. 1 is a partial radial cross-sectional view through the wall portion of a rotary piston compressor and through one exemplary embodiment of the inventive delivery valve taken in the direction of line I—I in FIG. 2.
Figure 2:
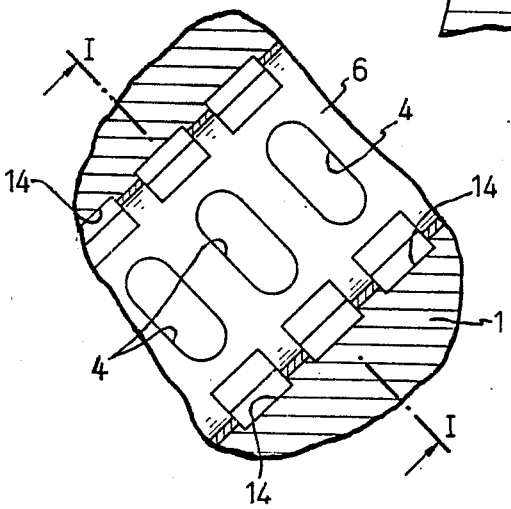
FIG. 2 is a partial axial cross-sectional view taken in the direction of the line II—II through the wall portion of FIG. 1, with the valve reeds and travel-receivers having been removed.

The delivery valve of the present invention is characterized primarily in that facing walls of the sleeve and its bore are recessed in the vicinity of the valve reeds to form pockets to permit gaseous medium to flow about bulged-out portions of the valve reeds in said opening position thereof.

The inventive pockets in the valve bore in the wall portion of the compressor and in the sleeve-like housing of the delivery valve can be easily produced by notching or recessing these parts with a grooving milling machine.

Further specific features of the present invention will be described in detail subsequently.

DESCRIPTION OF PREFERRED EMBODIMENTS

Referring now to the drawing in detail, shown only partially is the wall portion 1 of a rotary piston compressor of a trochoidal type of construction with a double arch peripheral running surface 2 and a non-illustrated triangular piston. In the direction of rotation of this piston, after a par-axis zone 3 of the running surface 2, the wall portion 1 is provided with a plurality of delivery or outlet slots 4 that extend in the circumferential direction. These slots 4 open into an axial bore 5 in the wall portion 1. On both sides of the wall portion 1, this bore 5 communicates with pressure chambers in the non-illustrated side members of the rotary piston compressor, with these pressure chambers in turn opening toward the pressure or delivery connections.

A sleeve 6 is inserted into the bore 5 so as to fit tightly therein. The sleeve 6 can have cutouts in a radial direction so that the sleeve can rest resiliently against the wall of the bore 5. Placed in the sleeve 6 is a stroke or travel-receiving component 7 that on the one hand rests against a continuous back or ridge 8 (shown in cross-section in FIG. 1) and on the other hand rests against a spacer 9 on the sleeve 6. The actual travel-receivers 10 are disposed in front of the delivery slots 4 at the distance illustrated in FIG. 1 and form between themselves spaces 11 that are continuous up to the ridge 8. Valve tongues or reeds 13 are supported in the angled parts 12 between the bases of the travel-receivers 10 and the ridge 8. These valve reeds 13 are cut out of a steel plate in such a way that they retain connecting edge strips that pivotably rest in the angled parts 12. The valve reeds 13 are bent around the travel-receivers 10, being bent in an essentially circular manner in the closure position and being bent essentially in the form of an ellipse in the opening position so that the elliptically rounded portions, with a small radius, extend to nearly the inner radius of the sleeve 6. In the closure position, the valve reeds 13 are indicated by solid lines and the reference numeral **13*a*, and in the opening position the valve reeds are indicated by dashed lines and the reference numeral 13*b***.

In order to enlarge the flow paths of the pressurized gases that exit through the valve, and that initially extend in the axial direction about the travel-receivers 10 and valve reeds 13 and between the travel-receiving components 7, the sleeves 6 and the walls of the bores 5 are enlarged in the region of the valve reeds 13 by notching or recessing the same to form pockets 14. In so doing, the sleeve 6 is cut at an angle in the circumferential direction so that a smooth, continuous, round indentation surface results. The pockets 14 extend from the level of the pertaining end of the abutment surface of the travel-receiver 10 about an angle of greater than 90° to behind the ridge 8 of the travel-receiving component 7. The depth of these pockets, measured from the pertaining endpoint of the long axis of the ellipse formed by the valve reeds upon opening is exactly equal to the distance of the abutment surface of the travel-receivers 10 from the sleeve 6. The discharge path of the pressurized gases therefore always has the same width from the inlet slots about the bulges of the valve reeds. The lateral discharge in the radial direction is not obstructed along this entire path. Without the inventive pockets, the radial discharge path would become continuously narrower until deflection about the valve reeds, and flow of pressurized gases would therefore become very turbulent and would wedge, thrash or come to blows.

The pockets 14 are most expediently produced with a groove cutter after the sleeves have been placed in the bores 5, in order to obtain a uniform transition of the walls of these pockets from the inner surfaces of the sleeve 6.

The present invention is, of course, in no way restricted to the specific disclosure of the specification and drawing, but also encompasses any modifications within the scope of the appended claims.

What I claim is:

1. In a pressurized gas delivery valve that includes a housing in the form of a cylindrical sleeve having valve slots that extend in a circumferential direction and in front of which are disposed cylindrically bent valve reeds that in an opening position rest against travel-receivers in an elliptically bent configuration, with said sleeve being disposed in a wall portion free of any screw fastening as fitted snugly directly of a rotary piston compressor for gaseous medium, said sleeve being disposed in said wall portion in a bore thereof that extends parallel to a shaft axis of said compressor, with said bore communicating with a respective delivery chamber of said compressor via delivery ports in said wall portion, and in the radial direction communicating on at least one side with a delivery line, comprising the improvement therewith wherein:

facing walls of said sleeve and said bore are recessed with milled cuts via a groove cutter in the vicinity of said valve reeds to form pockets to permit gaseous medium to flow about bulged-out portions of said valve reeds in said opening position thereof and to obtain a uniform transition of the walls of these pockets from inner surfaces of said sleeve.

2. A delivery valve according to claim 1, in which said travel-receivers are part of a component that includes a ridge means disposed in said bore, against said sleeve, remote from said travel-receivers, with said pockets extending more than 90° from beneath said ridge means to the region of ends of surfaces against which said valve reeds are adapted to rest in said opening position thereof.

3. A delivery valve according to claim 2, in which said pockets have a width that is greater than that of said valve reeds.

4. A delivery valve according to claim 2, which includes spacer means to space said travel-receivers from said sleeve, with said pockets having a depth, measured from a pertaining end of the long axis of the ellipse formed by said valve reeds in said opening position thereof, that is equal to the distance from said sleeve of surfaces of said travel-receivers against which said valve reeds are adapted to rest in said opening position thereof.

* * * * *